US006511241B2

(12) United States Patent
Fetherolf et al.

(10) Patent No.: US 6,511,241 B2
(45) Date of Patent: Jan. 28, 2003

(54) INTEGRAL ACTUATION LINKAGE FOR PAPER DIVERTER FOR SWITCH TO STRAIGHT-THROUGH PAPER PATH

(75) Inventors: Will Fetherolf, Boise, ID (US); Curtis Gregory Kelsay, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 122 days.

(21) Appl. No.: 09/759,866

(22) Filed: Jan. 12, 2001

(65) Prior Publication Data

US 2002/0093135 A1 Jul. 18, 2002

(51) Int. Cl.[7] ..... B65H 29/60

(52) U.S. Cl. ..... 400/664; 400/595; 271/303; 347/139

(58) Field of Search ..... 271/301, 303; 400/595, 599.1, 642, 663, 664, 625; 347/139

(56) References Cited

U.S. PATENT DOCUMENTS

| | | | | | |
|---|---|---|---|---|---|
| 3,912,389 | A | * | 10/1975 | Miyamoto | 271/213 |
| 3,918,701 | A | * | 11/1975 | Lee | 271/181 |
| 4,750,016 | A | | 6/1988 | Kusumoto et al. | 355/3 |
| 5,118,093 | A | * | 6/1992 | Makiura et al. | 271/213 |
| 5,184,734 | A | | 2/1993 | Yamaguchi | 209/657 |
| 5,201,518 | A | | 4/1993 | Isoda | 271/305 |
| 5,234,213 | A | * | 8/1993 | Chen | 271/186 |
| 5,237,381 | A | | 8/1993 | Hamada | 355/321 |
| 5,263,706 | A | | 11/1993 | Okada | 271/287 |
| 5,343,223 | A | * | 8/1994 | Tohyama et al. | 347/134 |
| 5,415,391 | A | | 5/1995 | Wong et al. | 271/225 |
| 5,472,185 | A | | 12/1995 | Kollann et al. | 271/303 |
| 5,478,061 | A | * | 12/1995 | Murakami et al. | 270/58.08 |
| 5,586,758 | A | * | 12/1996 | Kimura et al. | 271/186 |
| 5,655,765 | A | | 8/1997 | Asami et al. | 271/185 |
| 5,788,229 | A | | 8/1998 | Asami et al. | 271/305 |
| 5,862,435 | A | * | 1/1999 | Suzumi et al. | 399/405 |
| 5,887,867 | A | * | 3/1999 | Takahashi et al. | 271/117 |
| 6,011,940 | A | | 1/2000 | Van Lydegraf | 399/87 |
| 6,332,611 | B1 | * | 12/2001 | Tomita | 271/273 |

* cited by examiner

*Primary Examiner*—Andrew H. Hirshfeld
*Assistant Examiner*—Dave A. Ghatt

(57) ABSTRACT

Embodiments of an improved media output paper control system are described, the improved system including a mechanical linkage between a housing door of an image forming device, such as a printer, and a media diverter that changes direction of the media exiting the print engine. The mechanical linkage provides a sure method of switching the media path from a face-down output mode to a face-up output mode, by directing media to the housing door whenever it is open, thus, allowing, the housing door to become an output tray. The preferred mechanical linkage includes a member pivotally connected to, and extending between, the door and the diverter, in such a way that pivoting the door also pivots the diverter to a lesser degree. The preferred linkage member includes an elongated slot or channel at one end for pivotally and slidably receiving a portion of the diverter, so that the linkage member may pivot and slide relative to the diverter, when the door is being opened and closed, until a point where the linkage member engages the diverter to rotate the diverter the required amount.

6 Claims, 4 Drawing Sheets

INTEGRAL ACTUATION LINKAGE FOR PAPER DIVERTER FOR SWITCH TO STRAIGHT-THROUGH PAPER PATH

FIELD OF THE INVENTION

This invention relates to mechanisms for controlling the output paper path in an image-forming apparatus, such as an electrophotographic or other printer. More specifically, this invention relates to a linkage between a pivotal housing door and a media-directing member, so that movement of the door between two positions causes the directing member to guide paper or other media into two different paths.

BACKGROUND ON THE INVENTION

Several prior art image-forming devices, such as computer printers sized for desk-top use, have been provided with two media output trays, typically a face-down media-output tray and a face-up output tray. One of the output trays is typically at the end of a non-straight paper path, in which path the paper makes one or more turns between the print engine and the tray. The other of the output trays is typically at the end of a straight-through paper path, in which path the paper makes little, if any, change of direction between the print engine and the tray. Because paper typically exits the print engine with the printed side up, and the non-straight paper path typically turns the paper over relative to its orientation as it exits the print engine, the tray at the end of the non-straight paper path is a face-down tray. Because the straight-through paper path does not change the orientation of the paper after it exits the print engine, the tray at the end of the straight-through path is a face-up tray.

The face-down output tray is typically at the top of the printer housing, and paper exiting from the print engine curves generally vertically upwards and around about 130–180 degrees to rest face-down in the tray. In the face-down tray, pages stack facing downward in correct order.

The face-up output tray is typically a pivotal housing door in front of the print engine, wherein "front" is so defined as the general direction of paper travel as it leaves the fusing station of the print engine. The face-up tray is positioned relative to the print engine so that paper moves generally straight forward horizontally from the print engine, with print facing upwards, and straight out of the housing into the face-up tray without any significant turns in its path. In the face-up tray, pages stack face-up in reverse order, with the first-page facing up at the bottom of the stack and the last-page facing up at the top of the stack.

Typically, the housing door is designed to lie smoothly against the printer housing in a generally vertical position when the door is closed. When the door is fully opened, it pivots out and down from the printer housing to rest in the proper position to serve as a paper-receiving tray, which is a generally horizontal position in front of the print engine.

The face-up tray is normally chosen when a user wants a substantially straight-through paper path, to minimize curling of an envelope, transparencies, or postcards, or when a user wants paper to exit and stack face-up. In the past, the face-up tray is selected when the user manually flips a small, tab-style handle or switch on the outside of the housing that is connected to a media-directing member. This way, the user directly controls the media-directing member and may flip it back and forth between its two positions, while keeping track of the directing member's position by noting the position of the small handle.

The media-directing member is sometimes called a "vane" and includes a media-contact surface extending along or spaced along a rotatable shaft, the shaft being transversely disposed to the direction of paper travel. When the manual handle rotates the vane to place the media-contact surface in the way of the advancing media, the typically-curved media-contact surface directs the paper to move in the first, turning path. When the manual handle rotates the vane to move the media-contact surface out of the way, and, optionally, to move a second surface of the vane into the path of the paper, the vane then "directs" (or allows) the paper into the second, straight-through path. "Automatic" methods of switching the paper path between two paper trays have been designed, as a way to make the switching easier and to make it more evident whether the printer is in face-up or face-down output mode. Several of the methods are shown in U.S. Patents. For example, Chen (U.S. Pat. No. 5,234,213, issued Aug. 10, 19993) discusses two control systems in which manual movement of a housing door automatically changes the paper path, as discussed below.

The system labeled as "prior art" in Chen comprises a paper guide with generally triangular members on a shaft. Each triangular member has a concavely-curved hypotenuse surface that serves as a guide to urge paper upwards to a first, upper paper tray at the top of the printer housing. The paper guide has a crank extending radially from the shaft that is biased by a spring into a generally downward position, which causes the hypotenuse surfaces generally to face the oncoming paper from the print engine. When in this biased position, the hypotenuse surfaces are tipped forward and slightly downward, so that the horizontally moving paper abuts into the hypotenuse surfaces and curves upward. A housing door is pivotally installed near, but unattached to, the paper guide. As the door pivots open to a generally horizontal position to act as an output paper tray, a bottom portion of the door pivots toward the crank and impacts the crank near its bottom, pushing the crank and pivoting the paper guide. This rotates the hypotenuse surfaces up to a more horizontal orientation, so that oncoming paper misses the hypotenuse surfaces and instead moves along the bottom of the triangular members, thus, keeping the paper generally horizontal as is moves into the open door tray.

Chen also discloses what Chen considers an improved, gravity-operated paper guide. The gravity-operated paper guide also includes a triangular member on a shaft with a crank, but the crank is so disposed as to affect the gravitational center of the paper guide. The crank is so designed, and the pivotal door so positioned relative to the crank, that, when the door closes, the door impacts the crank and pushes the crank upwards. Pushing the crank upwards in this way rotates the paper guide into the path of the oncoming paper, so that the paper-guiding surface forces the paper upward to the first output tray. Then, when the door opens, the door moves away from the contact with the crank, and the paper guide rotates by gravity out of the paper path. In this rotational position, the paper-guiding surface does not interfere with the paper, so that the paper continues its generally-horizontal travel below the paper guide to slide into the open door paper tray.

Kusumoto et al. (U.S. Pat. No. 4,750,016) discloses a tray and paper guide system, in which a cammed surface on a bottom portion of a pivotal tray cooperates with a paper guide shaft. The paper guide shaft is spring-biased to ride along the cammed surface as the door is pivoted inward (closed) and outward (open), causing the shaft of the paper guide to rotate and move downward into the paper path and upward out of the paper path, respectively.

Kimura et al. (U.S. Pat. No. 5,586,758) discloses a paper tray door system, in which a portion of the door itself serves as the paper guide surface when the door is closed. The door portion has a curved surface that, when the door is closed, is positioned directly in front of the paper discharge rollers, receives the paper and urges the paper upward to turn over the paper. When the door is opened, the curved surface is out of the way of the paper, so that paper continues its generally-horizontal travel into the door tray.

Still, there is a need for an improved system that allows the position of the door tray to control paper path selection. There is a need for such a control system that reliably links the door tray to the paper-directing member, so that the user automatically selects one output tray or the other by opening or closing the door tray. There is a need for such a system that makes it immediately apparent where printed media is being directed, that is, to a face-down tray or to a face-up tray. There is a need to such a system that is simple, durable, and reliable.

SUMMARY OF THE INVENTION

The present invention comprises apparatus for actuating a media path-controlling device in an image-forming device to switch to a straight-through operation. The present invention mechanically links a housing door/tray to a media-diverter member in such a way that the pivoting of the door/tray also pivots the media-diverter between two operative positions. Also, the present invention may comprise a method for increasing the certainty and ease with which paper or other media is switched to a straight-through path through a printer.

Objects of the invention include integrally linking a media-diverter to the door/tray, so there is a clear understanding of what exit path the media will take. When the door/tray is open, the media will exit into or near the door/tray. When the door/tray is open, the media will exit elsewhere, typically into the other of two output trays. The door/tray is mechanically linked to the diverter, so that the door/tray actively switches the diverter position, rather than the door/tray passively effecting the diverter. Rather than the door/tray simply moving out of the way of the diverter to allow it to swing from a first position into an alternative position, the door/tray of the present invention controls the diverter to quantitatively and clearly switch the diverter between two positions.

The preferred mechanical linkage includes an elongated linkage member extending between the door/tray and the diverter. The linkage member has connection points at its two opposite ends for moveable connection directly to the door/tray and directly to the diverter. One end of the linkage member has a pivotal connection and the other end of the linkage member has a pivotal and axially-slidable connection (that is, longitudinally slidable, parallel to the longitudinal axis of the linkage member). This way, the linkage member may translate the rotational motion of the door into linear motion of the linkage member and then to rotational motion of the diverter, wherein a given amount of rotation of the door/tray on a hinge surely and smoothly causes a lesser amount of rotation of the diverter.

When the door/tray is swung open, it pulls on the linkage member, which slides axially and slightly pivots relative to the diverter, while the diverter remains substantially motionless in its first position. When the door/tray reaches a certain position in its swing, the preferred linkage member no longer slides relative to the diverter and its further movement pulls the diverter to rotate into a second position. In reverse, when the door/tray is swung closed, the door/tray pushes on the linkage member, which slides axially and pivots slightly relative to the diverter, while the diverter remains substantially motionless in its second position. When the door/tray reaches a certain position in its swing, the preferred linkage member no longer slides relative to the diverter and its further movement pushes the diverter to rotate into the first position.

The preferred linkage member is an elongated, generally straight bar, strip, or rod, which has a pivotal axis at one end for connection to the door/tray, and an elongated recess at the other end for pivotal and slidable connection to the diverter. The elongated recess may be a slot, which extends all the way through the linkage member, or a channel, which may extend part way through the linkage member. In any case, the elongated recess pivotally and axially-slidably receives and retains a portion of the diverter for the desired control of the diverter position.

DETAILED DESCRIPTION OF THE INVENTION

Referring to the Figures, there are shown several, but not the only, embodiments of the invented paper path control system and an image-forming device in which the control system is used. Because the image-forming devices of greatest interest herein are computer printers, the devices are herein generally referred to as "printers" for convenience. The user-accessible member of the control system may be called a housing door or an output tray, but, for simplicity, is called "door" hereafter and in the claims. Also, even though the printers are preferably adapted for printing on may forms of media, "paper" is used for convenience but not with the intention of limiting application of the invention to only paper handling.

Figure 1:
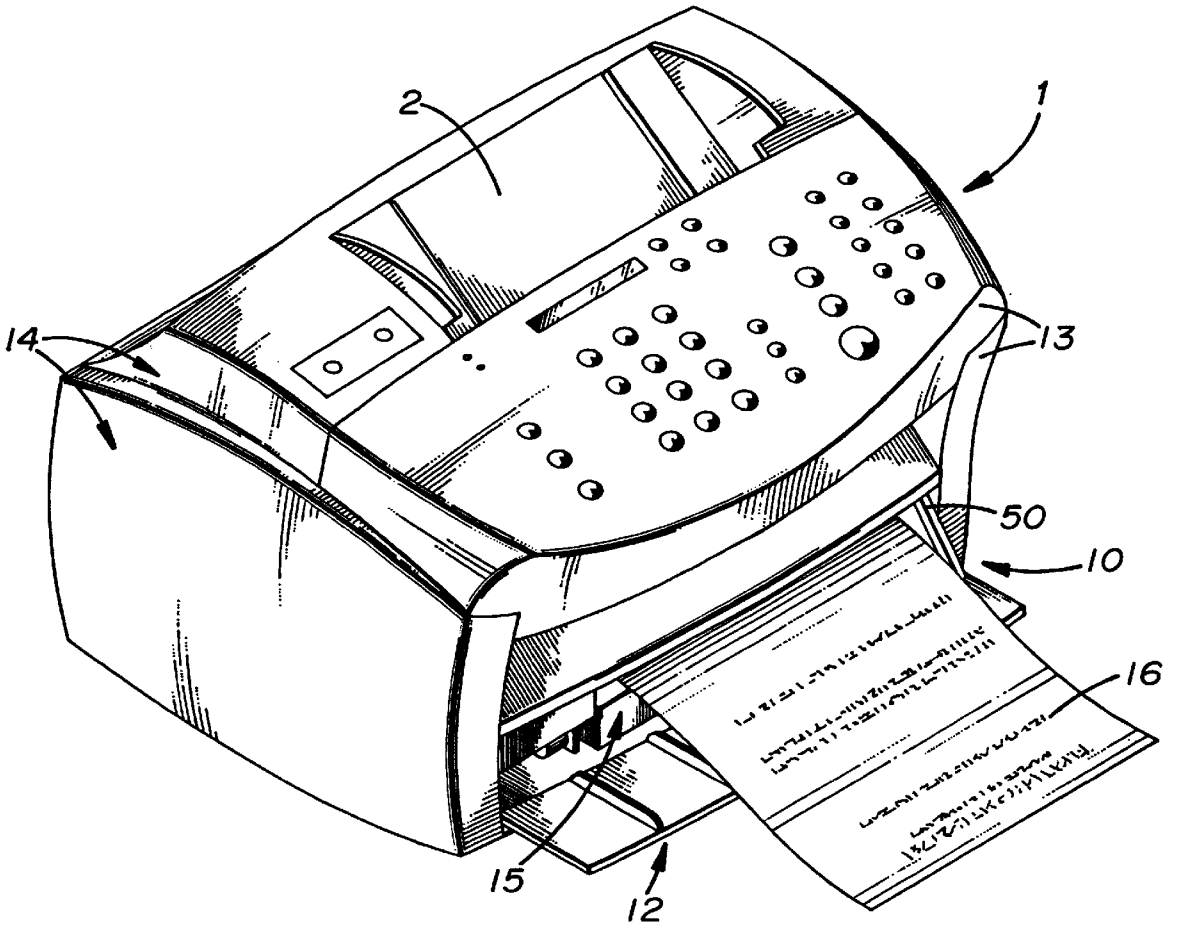
FIG. 1 is a perspective view of one embodiment of an image-forming unit, in this case an electrophotographic printer, that is adapted to include the invented paper path control system.

FIG. 1 illustrates one of many image-forming devices that may cooperate with the invented control system 10. The FIG. 1 device is a desk-top computer printer 1, preferably an electrophotographic printer. On the top of the printer, one may see the face-down tray 2, which is in front of a paper input tray 3 (hidden in FIG. 1). At the lower front of the printer is the face-up tray, which is the housing door 12, shown in FIG. 1 in an open position wherein it is swung out from the plane of the front housing panel 13 of the housing 14. When the door 12 is opened, one may see the straight-through output port 15, from which paper 16 exits from the printer 1 when the paper diverter 40 allows paper to travel straight out of the printer. When the door 12 is closed, it covers the output port 15.

Figure 2:
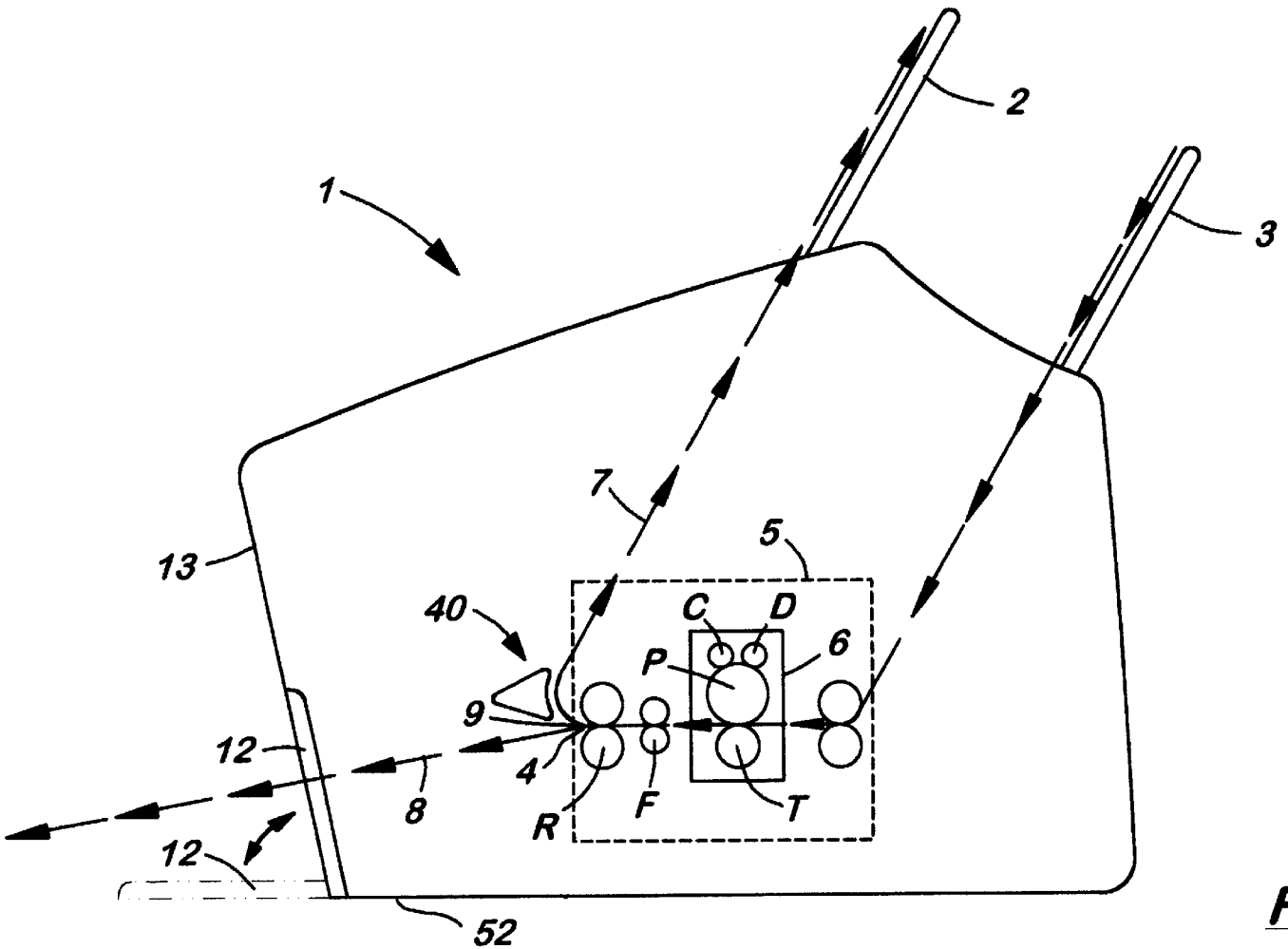
FIG. 2 is a schematic side view of the printer of FIG. 1 showing the pint engine, paper paths, and the face-up and face-down output trays.

FIG. 2 schematically illustrates an example of the internals and the paper paths of the preferred printer of FIG. 1.

The paper path includes an engine-output or "main" media path 4 exiting from the print engine 5 of the electrophotographic (EP) process 6, a first path 7, a second path 8, and a junction 9 between the first and second paths.

The electrophotographic (EP) print engine 5 is the heart of the printer. The EP print engine may be of typed known in the art, which comprise an EP process wherein a photoconductor drum P moves, for each image, through a charging station C, a developing station D, and a transfer station T. After the media exits the EP process, the image is fused onto the media at fusing stations F and then discharged by discharge rollers R. At or near the exit end of the discharge rollers is a diverter 40, which is shown schematically in FIG. 2 at or near the junction 9 where the main path 4 splits into the two paper paths 7, 8. The diverter 40 is rotatable into two positions, a first position in the path of the paper for diverting the paper to move along the non-straight paper path, and a second position entirely or substantially out of the paper path for allowing the paper to move along the straight-through paper path.

The diverter 40 works in a way generally similar to the media-directing member or "vane" discussed in the Related Art section above. In the first position, the diverter 40 is rotated into the junction 9 so that a guiding surface 42 faces and contacts the oncoming paper 16, changing the paper direction to turn it upward along the guiding surface and move it in a generally vertical and rearward path until it exits into the face-down tray 2. In the second position, the diverter 40 is rotated out of the junction 9 and entirely out of the way of the paper, allowing the paper to move substantially straight-forward to the face-up tray (door 12). Alternatively, when in the second position, the diverter 40 may be substantially out of the paper path and junction 9, but extend near enough to the paper to present a generally horizontal bottom surface 44 to the paper. In this alternative approach, the bottom surface 44 of the diverter 40 may serve as an upper limit for the paper, which may either guide the paper or deflect the paper slightly downward as the paper moves forward below the diverter 40.

The preferred diverter 40 is an elongated member that is rotatably mounted in the printer so that it can rotate on its longitudinal axis 46. The longitudinal axis 46 is positioned parallel to the plane of the media, and transverse to the direction of the media movement, as the media exits the discharge rollers. The guiding surface 42 of the diverter is slightly concave from its top edge 47 to its bottom edge 49 substantially all along the length of the diverter (into the paper in FIGS. 1–4). This way, whether paper is approaching the diverter in landscape or portrait orientation, the diverter 40 in its first position (FIG. 3) is well-placed in front of the paper to uniformly guide the paper into the upper paper path 7.

In the invented control system, a mechanical linkage is provided between the diverter 40 and the housing door 12 that serves as the fact-up media tray. The mechanical linkage provides a reliable, sure, and smooth way to control the diverter. The mechanical linkage allows manual control of the diverter via control of the door tray, which results in a clear visual signal, to anyone seeing the printer, of what output mode the printer is in.

Figure 3:
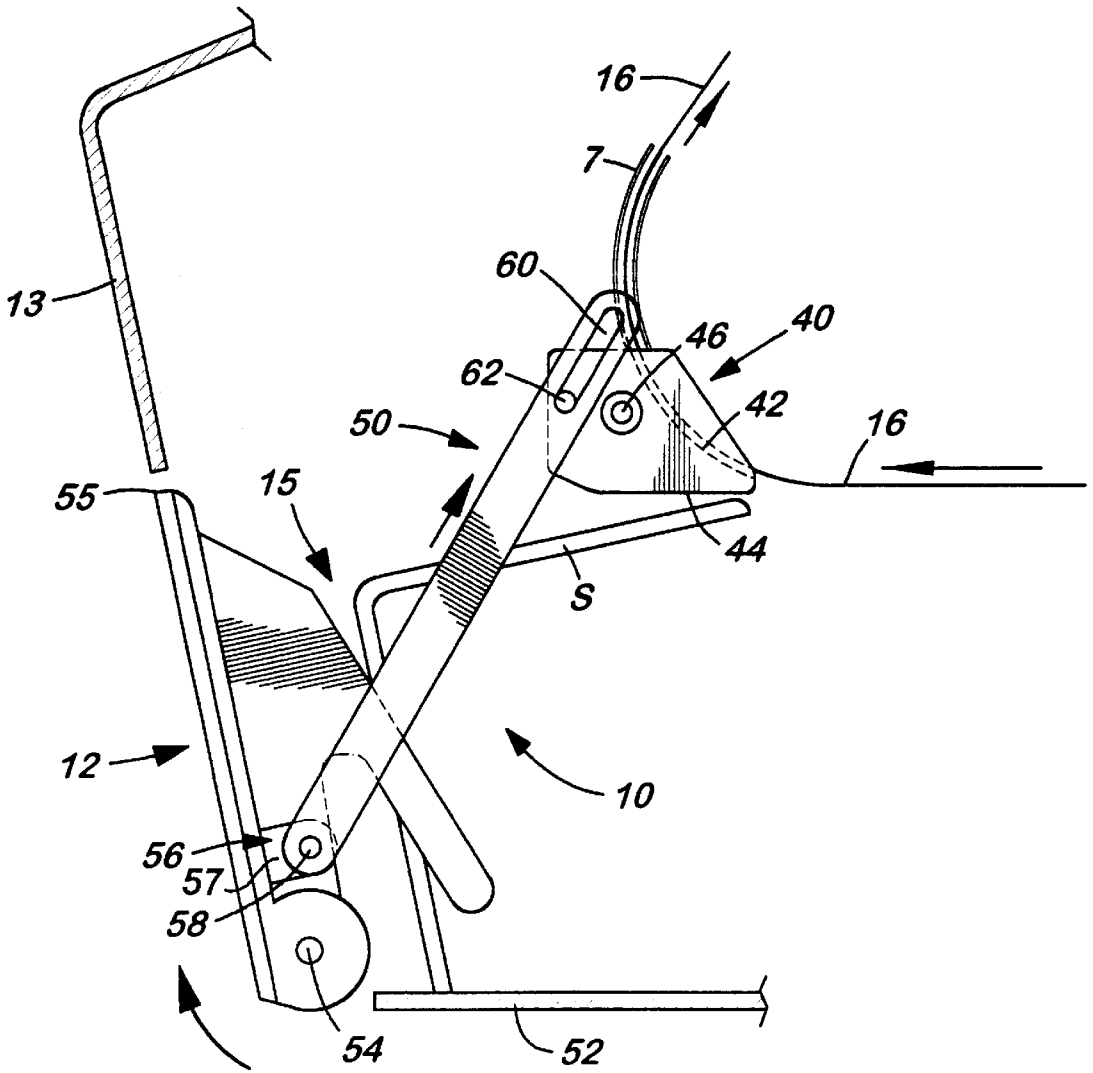
FIG. 3 is a partial side view of one embodiment of the invention, with the face-up tray closed and paper being directed into the top, face-down tray.
Figure 4:
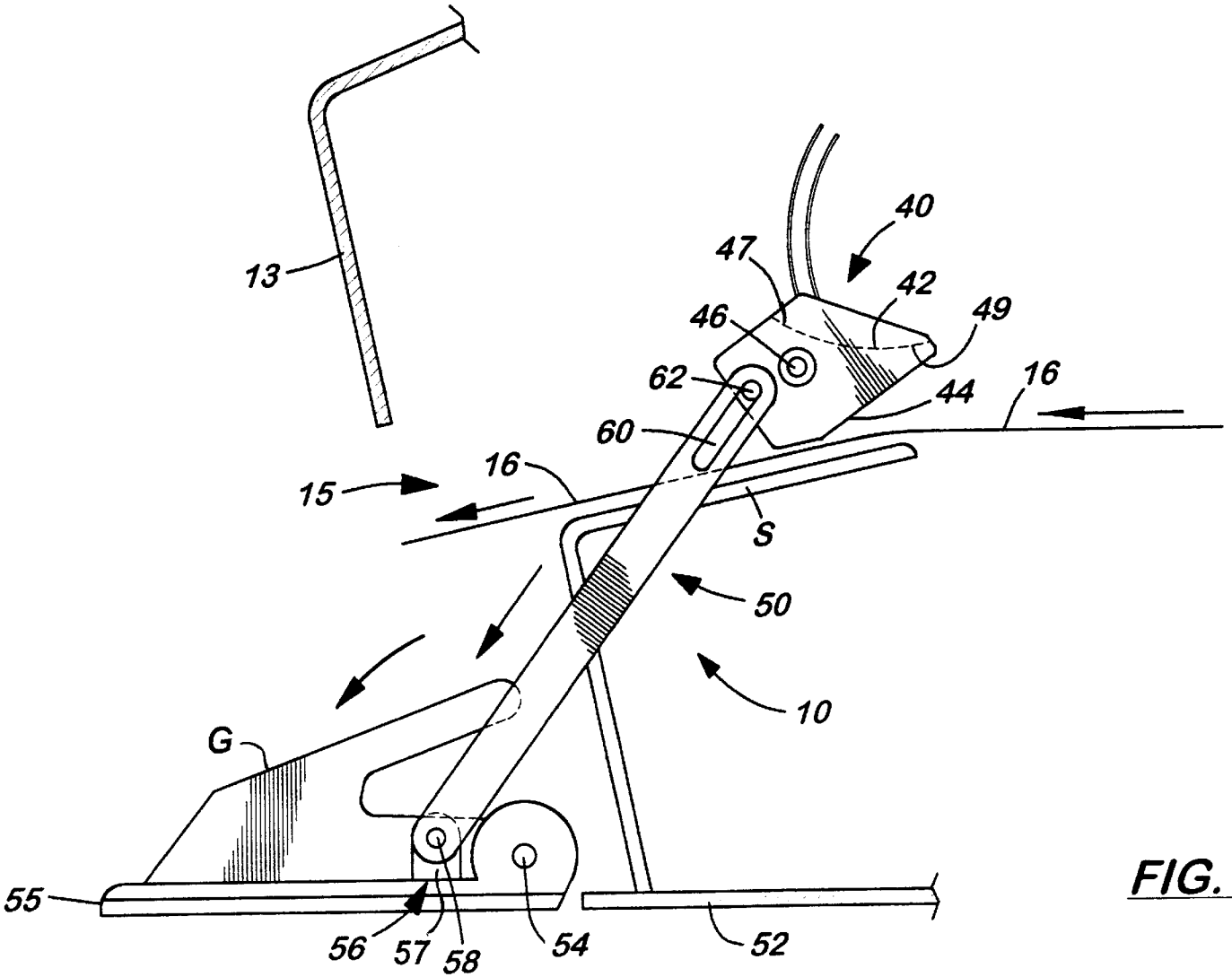
FIG. 4 is a partial side view of the embodiment of FIG. 3, showing a linkage between a face-up tray and a paper diverter, with the face-up tray in the open position and paper being directed into the face-up tray.

In the embodiment illustrated in FIGS. 3 and 4, the mechanical linkage comprises a linkage bar 50 extending between, and pivotally connected to, the door 12 and the diverter 40. The door 12 is a generally planar member pivotally connected to the printer housing, preferably but not necessarily, near the front bottom 52 of the printer. The door swings open by pivoting on its door axis 54, which extends from side to side on the front of the printer, the door axis 54 being transverse to the direction of paper travel. Near the top, outside edge of the door 55 is a recessed handle for grasping by the user. In its closed position, the door 12 is substantially flush with the rest of the front housing 13, and, in its open position, the door preferably rests horizontally on the desk in front of the printer.

The pivotal connection 56 between the linkage bar and the door preferably comprises a tab 57 or other connection member having a hole parallel to the pivotal axis 54 of the door. The linkage bar 50 is connected to the tab 57, by a peg 58 or other axis member on a first end of the bar being rotatably received in the hole, so that the linkage bar 50 can pivot relative to the door in a vertical plane perpendicular to the door pivotal axis, that is, parallel to the direction of paper travel.

The pivotal connection between the linkage bar and diverter preferably comprises the linkage bar having an elongated slot 60 near its second end. A diverter peg 62 or other portion of the diverter, which is radially distanced from the diverter rotational axis 46, is pivotally and slidably received in the elongated slot 60. With this pivotal connection, the linkage bar 50 rotates relative to the diverter 40 in a vertical plane perpendicular to the axis of the diverter. With the slidable connection, the linkage bar can move longitudinally relative to the diverter, so that the linkage bar slides relative to the diverter and does not exert significant force on the diverter until the bar has slid to the end of the elongated slot 60.

In use, therefore, when the door is closed, the linkage bar is disposed at an acute angle to the door, with the door and the bar pivoted close together into a V-shape when viewed from the side, as in FIG. 3. The linkage bar 50 is slid up to the fullest extent so that the diverter peg 62 is at the bottom of the slot 60. To rest in the F-U-door-closed position, the door 12 has been pivoted toward the printer (inward, rearward), which has pivoted and slid the linkage bar inward and upward until the diverter peg is pushed up and rearward, which action rotates the diverter clock-wise in FIG. 3. This rotation moves the guiding surface 42 of the diverter into the generally horizontal path of the oncoming paper. Further, the paper path 7 after the diverter 40 is shaped to turn the paper further upwards and rearward. Thus, the apparatus in FIG. 3 is positioned to divert oncoming paper 16 or other media upwards and rearwards to exit at the face-down tray 2.

When the door 12 is opened, as illustrated in FIG. 4, the door pivots away from the printer (outward, forward), which pulls the connection point between door 12 and linkage bar 50 forward and downward in a vertical arc equal to the amount of pivot of the door. The linkage bar 50 is therefore pulled by the door forward and downward, which slides the bar down and pivots the bar lower end out. The upper end of the bar 50 pivots clockwise relative to the diverter peg 62 and slides down relative to the diverter peg 62 by virtue of the slot 60 sliding longitudinally relative to the peg. When the linkage bar slot 60 has slid the maximum relative to the diverter peg 62, the diverter peg 62 is pulled by the top end of the slot, which results in the diverter 40 being rotated counter-clockwise in FIG. 4. Because the diverter peg 62 and the guiding surface 42 are generally diametrically opposed, rotation of the diverter peg 62 in a counter-clockwise direction down toward the door 12, rotates the guiding surface up out of the paper path.

In the embodiment of FIGS. 3 and 4, rotational motion of the door 12 is translated to linear motion of the linkage bar 50, and linear motion of the linkage bar 50 is translated to rotational motion of the diverter 40. The linkage bar is connected to the door at the connection point 56, about ¼–⅓ of the way from the door axis 54 to the top edge 55 of the door. One may see from FIGS. 3 and 4 that, with this placement of the connection point 56 and with the door adapted to pivot in the range of about 70–90 degrees, and more preferably 70–80 degrees, for example, the preferred degrees of rotation of the linkage bar connection point on the door also about 70–90 degrees, or more preferably 70–80 degrees, that is, the same as the door. On the other hand, the diverter preferably only rotates about 20–40 degrees. Because the degrees of rotation of the linkage bar connection (point 56) to the door is significantly more than the desired diverter rotation, the elongated slot 60, and the resulting axial and rotational movement of the linkage bar 50 upper end relative to the diverter 40, create an appropriate linkage that provides the desired rotations. The length of the slot is specially- sized to translate the door rotation into just the desired amount of rotation of the diverter.

In FIG. 4, one may see the positions for the diverter 40, and the door 12, linkage bar 50, and slot 60 relative to the diverter peg 62, when the door 12 is fully opened. In this mode, paper 16 moves horizontally towards the diverter 40, and slides below the diverter 40 towards the port 15. Optionally, as suggested by FIG. 4, the bottom surface 44 of the diverter may serve to guide or limit the paper into the straight-through path 8. A support surface S may be supplied in the printer as a bottom limit or guide to the paper in this path 8. Optionally, additional support or guiding structure G may be included on the inner/upper surface of the door 12, as a means for retaining media within a desired area of the door 12 or to help guide or support the media as it exits the device 1.

When in the open-door mode, linkage bar 50 rests at an obtuse angle to the door 12, after having pivoted outward and downward. For example, one may see that the angle of the linkage bar in FIG. 4 is generally about 130 degrees to the door, while the angle of the linkage bar in FIG. 3 is about 40–45 degree to the door.

As illustrated in FIG. 1, the invented linkage system may comprise a single linkage bar installed on only one side of the door 12. The linkage bar 50 may be positioned at the end of the diverter 40 and at the side of the door 12, so that the linkage bar's movement does not interfere with the paper path or the other structure of the image-forming device. Preferably, the linkage bar is generally straight and rigid, without any joints or moving portions.

Optionally, one may include a system for urging the diverter 40 to be stable only in two positions, that is, the first position and the second position described above. Such a system may be a biasing system, including a spring (not shown) or other member(s) that urge the diverter to rest in either of the two positions but not between the two positions, with the linkage member 50 serving as the actuation member for moving the diverter 40 between the two positions. This way, when the door 12 closes and the linkage member 50 pushes the diverter 40, the diverter 40 "trips" or "snaps" into the desired first position to divert paper up to the face-down tray 2. When the door 12 opens and the linkage member 50 pulls the diverter, the diverter 40 then "trips" or "snaps" into the desired second position. This feature may have several benefits, including that the diverter 40, at a certain point in its actuation by the linkage bar 50, moves quickly between the two positions and does so with certainty. Optionally, that "certain point" may be designed to be when the door 12 has been partially opened, but not necessarily completely opened, so that the diverter will still trip with certainty, even if something prevents the door form opening completely. With such a "trip" design, the user knows that the diverter 40 is properly switched in position, because he/she tends to feel the "trip" of the diverter as he/she opens the door 12. Also, because the diverter in such an embodiment would move quickly and surely between the two positions rather than moving at a continuous rate, the diverter is unlikely to be "caught" in an intermediate position between the two positions with paper approaching. Such a trip system is less likely to cause an internal paper jam. As an option, the shape of the elongated slot 60 or the length and shape of the linkage member may be adjusted to adjust the point and the "feel" of the tripping.

Although this invention has been described above with reference to particular means, materials and embodiments, it is to be understood that the invention is not limited to these disclosed particulars, but extends instead to all equivalents within the scope of the following claims.

What is claimed is:

1. On an image-forming device comprising a housing, a print engine, a media path with a direction of media travel exiting the print engine and connecting to a first path branch and a second path branch at a junction, the improvement in said device comprising:

a door pivotally connected to the housing at an outer end of the second path branch so that the door is closable to a first position near the housing and openable to a second position extending out from the housing;

a diverter being rotatably mounted near said junction and having a guiding surface for changing media direction; and a linkage member pivotally connected to the door at one end and pivotally connected to the diverter at a second end, so that pivoting of the door into the second position pulls the linkage member to rotate the diverter from a first diverter position in which the guiding surface is in the junction to a second diverter position in which the guiding surface is out of the junction;

the linkage member having a longitudinal axis and an elongated slot parallel to the longitudinal axis, wherein the elongated slot rotatably and slidably receives a portion of the diverter, so that the linkage member slides longitudinally relative to said portion of the diverter and so that the linkage member pivots around said portion; and the diverter having a rotational axis, wherein the guiding surface and said portion of the diverter are diametrically opposed on the diverter; and wherein the linkage member pulls down on said portion of the diverter when the door is opened to the second position so that the guiding surface moves upward out of said junction.

2. In the image-forming device of claim 1 the improvement further comprising:

wherein said door has a door axis where the door is pivotally connected to the housing at said outer end of the second path branch, a top outer edge opposite the door axis, and a distance between the door axis and the top outer edge; and wherein said linkage member is pivotally connected to the door at a connection point between said door axis and said top outer edge.

3. In the image-forming device of claim 2, the improvement further comprising:

wherein said connection point is located at from ¼ to ⅓ of the distance from the door axis to the top outer edge.

4. On an image-forming device comprising a housing, a print engine, a media path with a direction of media travel exiting the print engine and connecting to a first path branch and a second path branch at a junction, the improvement in said device comprising:

a door pivotally connected to the housing at an outer end of the second path branch so that the door is closable to a first position near the housing and openable to a second position extending out from the housing;

a diverter being rotatably mounted near said junction and having a guiding surface for changing media direction; and a linkage member pivotally connected to the door at one end and pivotally connected to the diverter at a second end, so that pivoting of the door into the second position pulls the linkage member to rotate the diverter from a first diverter position in which the guiding surface is in the junction to a second diverter position in which the guiding surface is out of the junction;

the linkage member having a longitudinal axis and an elongated slot parallel to the longitudinal axis, wherein the elongated slot rotatably and slidably receives a portion of the diverter, so that the linkage member slides longitudinally relative to said portion of the diverter and so that the linkage member pivots around said portion; and the diverter having a rotational axis, wherein the guiding surface and said portion of the diverter are diametrically opposed on the diverter; and wherein the linkage member pushes up on said portion of the diverter when the door is closed to the first position so that the guiding surface moves down into said junction

5. In the image-forming device of claim 4, the improvement further comprising:

wherein said door has a door axis where the door is pivotally connected to the housing at said outer end of the second path branch, a top outer edge opposite the door axis, and a distance between the door axis and the top outer edge; and wherein said linkage member is pivotally connected to the door at a connection point between said door axis and said top outer edge.

6. In the image-forming device of claim 5, the improvement further comprising:

wherein said connection point is located at from ¼ to ⅓ of the distance from the door axis to the top outer edge.

* * * * *